US009004958B2

(12) United States Patent
Nabeta

(10) Patent No.: US 9,004,958 B2
(45) Date of Patent: Apr. 14, 2015

(54) SINGLE CORE ELECTRIC WIRE AND TERMINAL CRIMPING STRUCTURE OF SINGLE CORE ELECTRIC WIRE

(75) Inventor: Yasunori Nabeta, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 3 days.

(21) Appl. No.: 14/116,484

(22) PCT Filed: Jun. 22, 2012

(86) PCT No.: PCT/JP2012/066626

§ 371 (c)(1), (2), (4) Date: Nov. 8, 2013

(87) PCT Pub. No.: WO2013/005657

PCT Pub. Date: Jan. 10, 2013

(65) Prior Publication Data

US 2014/0087604 A1 Mar. 27, 2014

(30) Foreign Application Priority Data

Jul. 1, 2011 (JP) ..... 2011-147057

(51) Int. Cl.

*H01R 4/10* (2006.01)
*H01R 4/18* (2006.01)
*H01B 7/00* (2006.01)

(52) U.S. Cl.

CPC ..... *H01R 4/18* (2013.01); *H01R 2201/26* (2013.01); *H01B 7/0009* (2013.01)

(58) Field of Classification Search

CPC ..... H01R 4/20; H01R 4/62; H01R 43/048; H01R 4/18; H01R 43/04; H01R 43/058; H01R 11/11

USPC ..... 439/877, 878, 882

See application file for complete search history.

(56) References Cited

U.S. PATENT DOCUMENTS

| | | | | |
|---|---|---|---|---|
| 5,796,043 | A | 8/1998 | Maruyama | |
| 7,544,892 | B2 * | 6/2009 | Susai et al. | 174/84 R |
| 7,901,257 | B2 * | 3/2011 | Okamura et al. | 439/877 |
| 8,485,853 | B2 * | 7/2013 | Seifert et al. | 439/882 |
| 8,622,776 | B2 * | 1/2014 | Morikawa et al. | 439/886 |
| 8,858,275 | B2 * | 10/2014 | Onuma et al. | 439/877 |

FOREIGN PATENT DOCUMENTS

| | | | |
|---|---|---|---|
| CN | 2462519 | Y | 11/2001 |
| JP | 2009-009736 | A | 1/2009 |
| JP | 2010-086848 | A | 4/2010 |

OTHER PUBLICATIONS

International Search Report and Written Opinion issued in corresponding International Patent Application No. PCT/JP2012/066626 mailed Sep. 25, 2012.

* cited by examiner

*Primary Examiner* — Xuong Chung Trans
(74) *Attorney, Agent, or Firm* — Banner & Witcoff, Ltd.

(57) ABSTRACT

Herein disclosed is a technique that suppresses the decrease of a contact pressure due to creep in a crimping part of a single core electric wire and a terminal. A single core electric wire 10 includes a hollow single core wire 20 and an electric wire coat 40. The hollow single core wire 20 includes a hollow part 30. The hollow part 30 is formed in a circular shape in section in the central part of a section of the hollow single core wire 20 and is formed in an extending direction, that is, a direction of a central axis of the hollow single core wire 20. Namely, the hollow single core wire 20 has a tubular form.

3 Claims, 5 Drawing Sheets

SINGLE CORE ELECTRIC WIRE AND TERMINAL CRIMPING STRUCTURE OF SINGLE CORE ELECTRIC WIRE

TECHNICAL FIELD

The present invention relates to a single core electric wire and a terminal crimping structure of a single core electric wire.

BACKGROUND ART

For instance, in a wiring of a wire harness installed in a motor vehicle, an electric wire is used which is obtained in such a way that a conductor such as copper or aluminum alloy is used as a core wire, a plurality of core wires are twisted together and the plurality of twisted core wires are coated with an electric wire coat. In such an electric wire, a terminal is attached to a terminal part of the conductor by crimping to connect the terminals to each other so that an electrical contact is established.

In a crimping part of the terminal and the electric wire (the core wires), reliability of connection may be occasionally deteriorated due to a decrease of contact pressure by creep or an aged deterioration. In order to solve the above-described problem, various techniques are proposed. For instance, a technique is proposed that, in an electric wire using aluminum for a core wire, the decrease of contact pressure due to creep or a mitigation of stress is prevented and a progress of the contact corrosion of dissimilar metals is suppressed to ensure a connection reliability (see, for example, patent literature 1). Further, another technique is proposed that a ring sleeve is used which has a serration formed to cause the surface of a conductor to be chamfered by crimping to prevent an aged deterioration of a crimping and connecting part as much as possible and improve reliability of electrical connection (see, for example, patent literature 2).

CITATION LIST

Patent Literature

[PTL 1] Japanese Patent Publication No. JP-A-2009-9736
[PTL 2] Japanese Patent Publication No. JP-A-2010-86848

SUMMARY OF INVENTION

Technical Problem

In a multi-core electric wire, as a sectional area of a conductor becomes larger, the number of core wires to be used becomes larger, which results in high production cost. Therefore, as an electric wire used in a position where a bending property is not necessary, a single core electric wire is occasionally used in place of the multi-core electric wire in view of reducing the production cost. FIGS. 1A to 1C show a structure of a crimping part 180 formed with a terminal 160 and an ordinarily used single core electric wire 110. FIG. 1A shows a structure of a section under a state before a crimping (caulking) operation. FIG. 1B and FIG. 1C are diagrams for explaining a contact pressure under a crimped state. In FIG. 1B and FIG. 1C, an electric wire coat 140 is omitted.

Immediately after the crimping part 180 is formed, the contact pressure is liable to be very high in an area A where two barrel end parts 166 are caulked so as to be joined to each other, then, in an area B opposed to the area A, the contact pressure is liable to be high, while in areas C in side surface parts, the contact pressure is liable to be low. As shown in FIG. 1C, when creep is generated, the contact pressure in the area A and the area B is lowered. These phenomena arise owing to a fact that the core wire is formed by a single core wire, a load is hardly dispersed during the crimping operation of a terminal, and therefore the contact pressure is concentrated on the area A and the area B while the contact pressure is low in the areas C. Especially, in the area A, the contact pressure is very high due to the form of the terminal which comes into contact with a core wire. Further, under an environment of high temperature (occasionally, even under an environment of low temperature), when the single core electric wire 110 creeps, the contact pressure is lowered due to the creep in the area A where the contact pressure is especially high. Accordingly, a problem arises that in the crimping part, a sufficient contact pressure cannot be ensured, which results in increasing a contact resistance of the single core electric wire 110 (a single core wire 120) and the terminal 160. Since the techniques disclosed in the patent literatures 1 and 2 relate to a technique for an electric wire including a plurality of core wires as an object, the above-described problem is not disclosed therein.

The present invention is devised by considering the above-described circumstances and it is an object to provide a technique that suppresses the decrease of a contact pressure due to creep in a crimping part of a single core electric wire and a terminal.

Solution to Problem

According to one aspect of the present invention, there is provided a terminal crimping structure of a single core electric wire, including a single core wire coated with an electric wire coat and a terminal fitting, wherein the single core wire has a hollow part formed therein along an extending direction, and the hollow part is collapsed in a crimping part of the exposed single core wire and the terminal fitting.

According to another aspect of the present invention, there is provided a single core electric wire, including a single core wire coated with an electric wire coat, wherein the single core wire includes a hollow part formed therein and the hollow part is collapsed when a terminal fitting is crimped in a part in which the single core wire is exposed.

The hollow part may be formed along an extending direction of the single core wire.

Advantageous Effects of Invention

According to the invention, it is possible to provide a technique that suppresses the decrease of a contact pressure due to creep in a crimping part of a single core electric wire and a terminal.

DESCRIPTION OF EMBODIMENTS

Figure 1A:
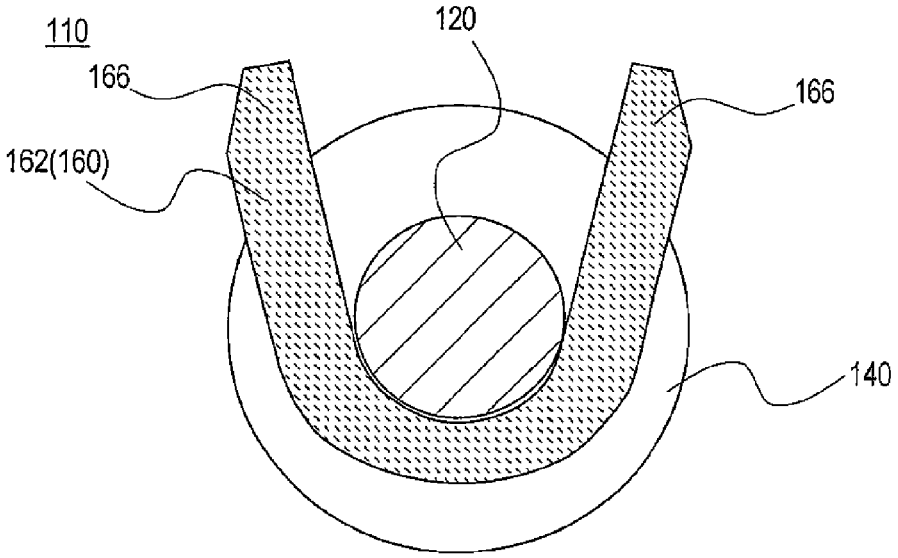
FIG. 1A is a diagram showing a structure of a crimping part formed with a terminal and a single core electric wire under a state before a crimping operation according to a usual technique.
Figure 1B:
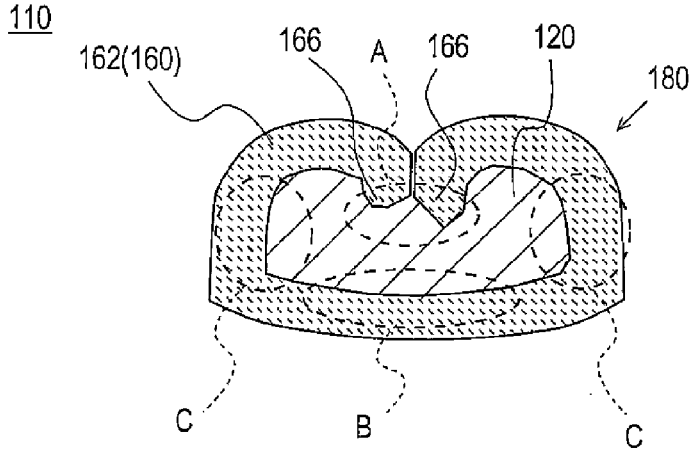
FIG. 1B is a diagram for explaining a contact pressure under a crimped state according to a usual technique.
Figure 1C:
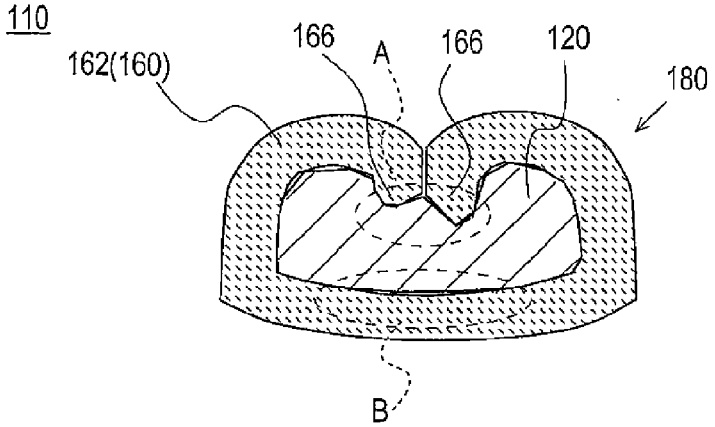
FIG. 1C is a diagram for explaining a contact pressure under a crimped state according to a usual technique.
Figure 2A:
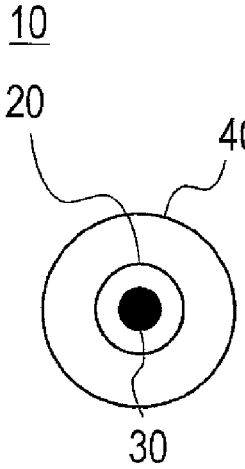
FIG. 2A is a diagram showing a single core electric wire according to an exemplary embodiment and seen from a terminal side in which a hollow single core wire 20 is exposed.
Figure 2B:
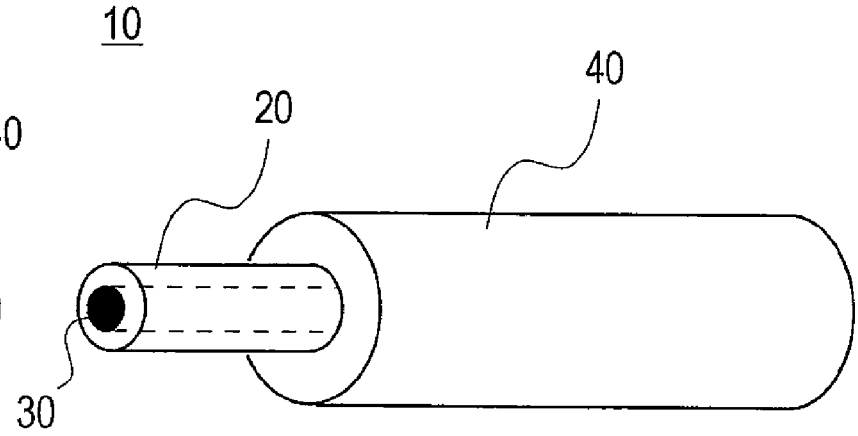
FIG. 2B is a diagram showing a single core electric wire according to an exemplary embodiment and is a perspective view of a side surface side.

Now, a mode for carrying out the present invention (refer it to as an "exemplary embodiment", hereinafter) will be described below by referring to the drawings. FIGS. 2A and 2B are diagrams showing a single core electric wire 10 according to the present exemplary embodiment. FIG. 2A is a diagram seen from a terminal side in which a hollow single core wire 20 is exposed. FIG. 2B is a perspective view of a side surface side. As shown in the drawings, the single core electric wire 10 includes a hollow single core wire 20 and an electric wire coat 40. The hollow single core wire 20 is a conductor made of, for instance, aluminum alloy, copper or copper alloy. The electric wire coat 40 is an insulating material covering the hollow single core wire 20. Here, in a terminal part of the single core electric wire 10, the electric wire coat 40 is peeled off by a prescribed length to expose the hollow single core wire 20.

Further, as a characteristic structure of the present exemplary embodiment, the hollow single core wire 20 includes a hollow part 30. As shown in the drawings, the hollow part 30 is formed in a circular shape in section in the central part of a section of the hollow single core wire 20 and is formed in an extending direction (a direction of a central axis) of the hollow single core wire 20. Namely, the hollow single core wire 20 has a tubular form. The sectional forms of the hollow single core wire 20 and the hollow part 30 are exemplified as the circular forms; however, the present invention is not limited thereto. Various kinds of forms which function as the single core electric wire 10 may be used.

Figure 3A:
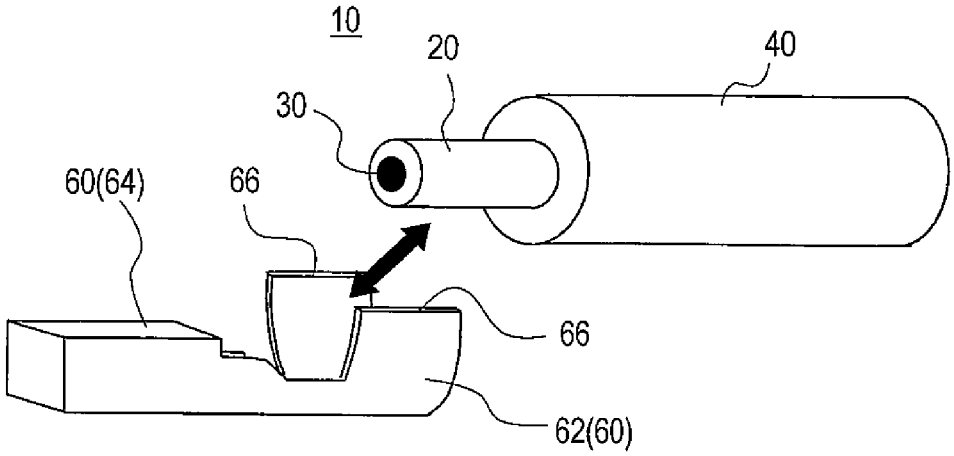
FIG. 3A is a diagram showing a state that the single core electric wire and the terminal are separately arranged before a crimping operation.
Figure 3B:
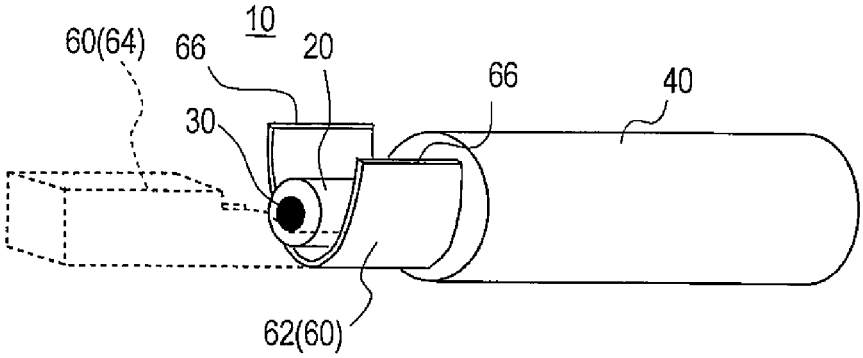
FIG. 3B is a diagram showing a state that the single core electric wire and the terminal are arranged immediately before the crimping operation.
Figure 3C:
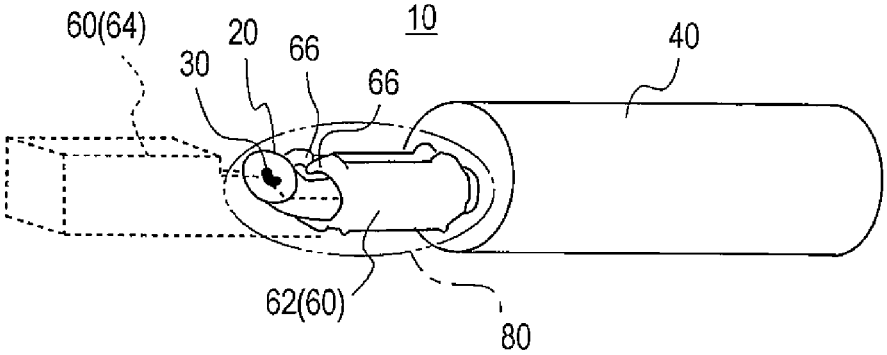
FIG. 3C is a diagram showing a state after the terminal 60 is crimped to the single core electric wire 10.

FIGS. 3A to 3C are diagrams showing a state that a terminal 60 is crimped to the hollow single core wire 20. Specifically, FIG. 3A shows a state that the single core electric wire 10 and the terminal 60 are separately arranged before a crimping operation. FIG. 3B shows a state the single core electric wire 10 and the terminal 60 are arranged immediately before the crimping operation. FIG. 3C shows a state after the terminal 60 is crimped to the single core electric wire 10. In order to pay attention to FIG. 3B and FIG. 3C, a connecting part 64 in the terminal 60 which is not related to the crimping operation is shown by a broken line.

The terminal 60 is an ordinary female type terminal and includes a barrel part 62 to be crimped and connected to the hollow single core wire 20 and a box shaped connecting part 64 connected to a corresponding male type terminal. The terminal 60 is formed in a prescribed shape by press working and then bending a plate material made of aluminum alloy, copper or copper alloy. Here, as the terminal 60, the female type terminal is exemplified; however, a male type terminal may be used.

As shown in FIG. 3A, in order to have the terminal 60 crimped to the single core electric wire 10, in the terminal part of the single core electric wire 10, the electric wire coat 40 is initially peeled off by a prescribed length to expose the hollow single core wire 20.

Figure 4:
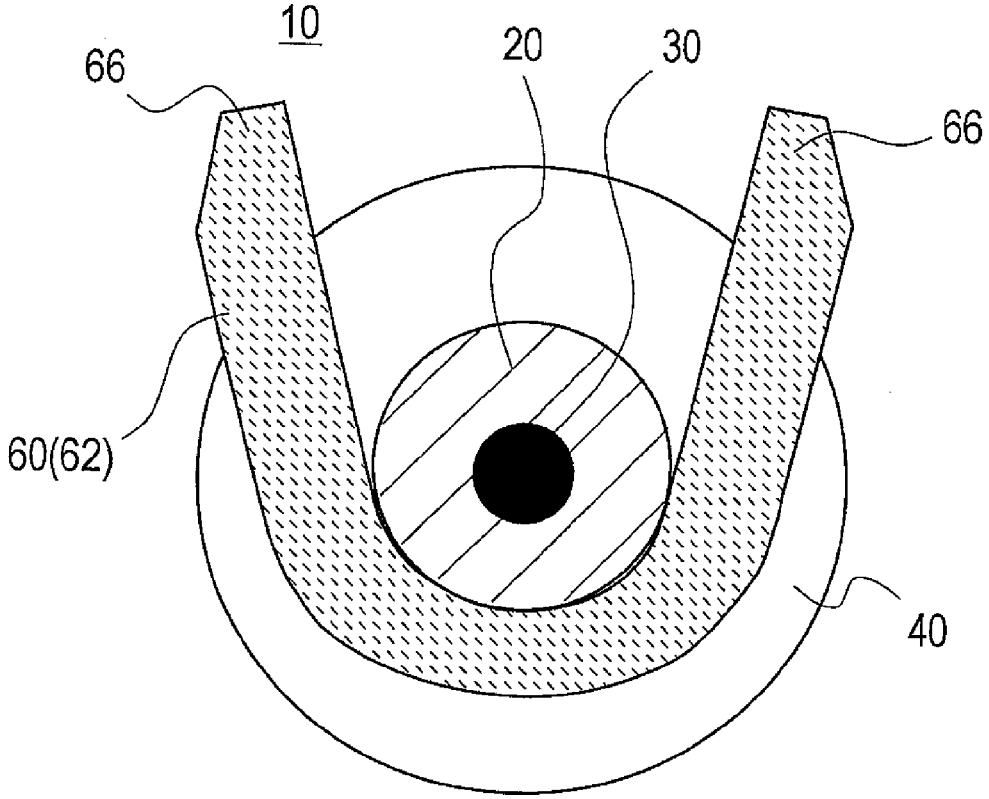
FIG. 4 is a diagram showing a crimping part before a crimping operation in the exemplary embodiment.

Then, as shown in FIG. 3B, a terminal part of the exposed hollow single core wire 20 is arranged in the barrel part 62 of the terminal 60. FIG. 4 shows a sectional view of a crimping part 80 corresponding to FIG. 3B. At this time, since a crimping jig does not operate, the hollow part 30 is not deformed and the section of the hollow part 30 remains circular.

Figure 5:
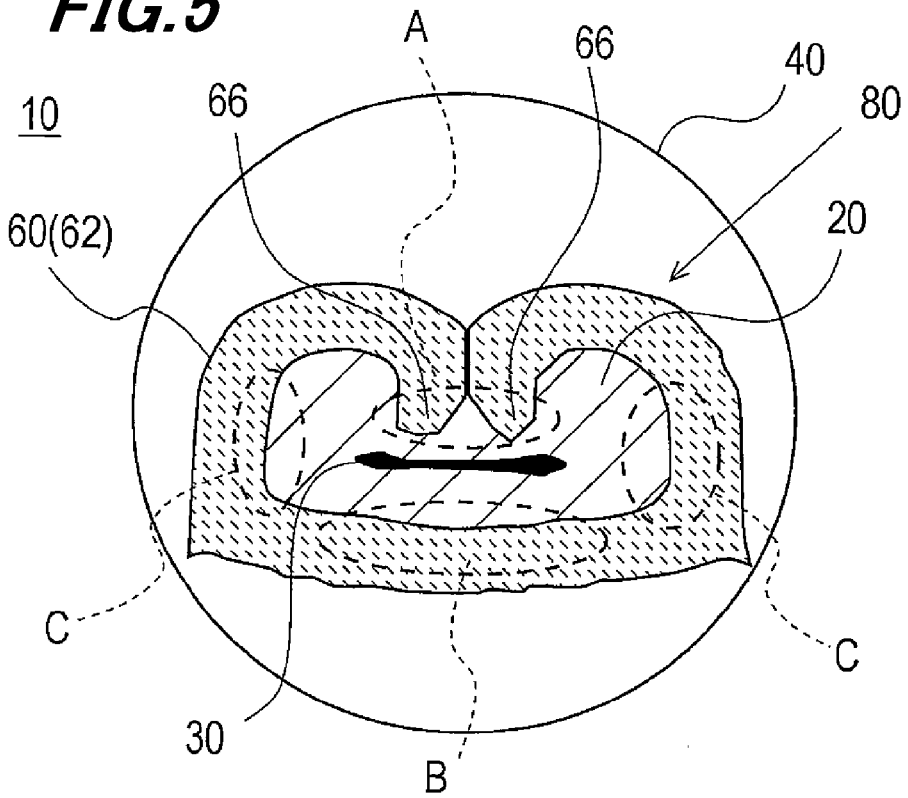
FIG. 5 is a diagram showing the crimping part under a crimped state in the exemplary embodiment.

Subsequently, as shown in FIG. 3C, both barrel end parts 66 of the barrel part 62 are crimped so as to be joined to each other so that the crimping part 80 is formed. FIG. 5 shows a sectional view of the crimping part 80 corresponding to FIG. 3C. As shown in the drawing, when the terminal 60 is crimped to the single core electric wire, the hollow part 30 is vertically collapsed in its section and has an elongated form in a transverse direction. When the hollow part 30 is collapsed in such a way, a load during the crimping operation is dispersed and equalized in an entire part of the crimping part 80, that is, areas A to C. As a result, a contact pressure of the hollow single core wire 20 and the terminal 60 is equalized. Accordingly, the decrease of the contact pressure due to creep is suppressed. Thus, an increase of contact resistance of the hollow single core wire 20 and the terminal 60 can be suppressed.

When the contact resistance of the hollow single core wire 20 and the terminal 60 is increased, it could happen that a voltage drop which is not estimated may arise or noise is generated due to instability of a voltage gap. For instance, in a recent vehicle, enormous data is transmitted and received to control the vehicle. Under circumstances that a small-signal transmission or a high speed transmission of signals is made, a large problem is to remove noise. Ordinarily, it is difficult and unstable to quantitatively grasp the increase of the contact resistance caused by the creep. Thus, the increase of the contact resistance constitutes a large problem in view of the compatibility of a cost and a signal quality in a signal transmission.

However, as in the present exemplary embodiment, when the hollow part 30 is provided to form the crimping part 80, the load in the crimping part 80 can be equalized as described above. Thus, since the contact pressure can be restrained from lowering, the increase of the contact resistance can be suppressed. Accordingly, an electrical connection of high quality is easily ensured even by the single core electric wire 10 of a low cost. As a result, since the voltage drop can be suppressed so as to be minimized, a transmitting efficiency can be improved. Further, the small-signal transmission or the high speed transmission of signals which is usually difficult can be achieved even by the single core electric wire 10. In a technical field of a high voltage power transmission from an electric power plant, a technique is known that a plurality of core wires having hollow structures are bundled and used as a high voltage electric wire (for instance, JP-UM-A-59-16010). However, this technique takes it into consideration to lighten a wiring, and a plurality of hollow pipe shaped aluminum wires are twisted in an outer layer side of a steel core (an inner layer) in this technique. Then, the hollow pipe shaped aluminum wires have their strength set so as not to be collapsed. Namely, this technique is based on an idea completely opposite to that of the present exemplary embodiment that the hollow part 30 is formed which is supposed to be collapsed.

The present invention is described above in accordance with the exemplary embodiment. It is to be understood to a person with ordinary skill in the art that the exemplary embodiment is an example and various modified examples of component elements and combinations thereof may be made and the modified examples are included within the scope of the present invention.

Figure 6A:
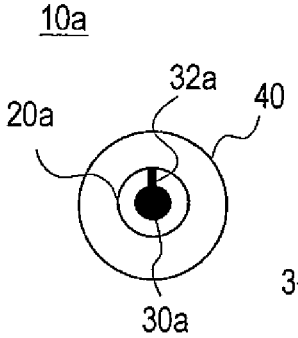
FIG. 6A is a diagram showing a single core electric wire according to a modified example of the exemplary embodiment and seen from a terminal side in which a hollow single core wire is exposed.
Figure 6B:
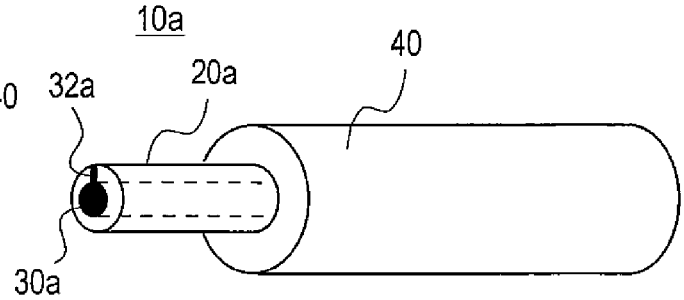
FIG. 6B is a diagram showing a single core electric wire according to a modified example of the exemplary embodiment and is a perspective view of a side surface side.

FIGS. 6A and 6B are diagrams showing a single core electric wire 10*a* according to a modified example. FIG. 6A is a diagram seen from a terminal side in which a hollow single core wire 20*a* is exposed. FIG. 6B is a perspective view of a side surface side. The single core electric wire 10*a* is different from the single core electric wire 10 shown in FIG. 2 in a form of a hollow single core wire 20*a*. Namely, the hollow single core wire 20*a* includes a hollow central part 30*a* having the same form as that of the hollow part 30 in section and a hollow side surface part 32*a* extending to an outer periphery from the hollow central part 30*a*. That is, the hollow single core wire 20*a* has a hollow structure of a substantially C shaped section.

Figure 7:
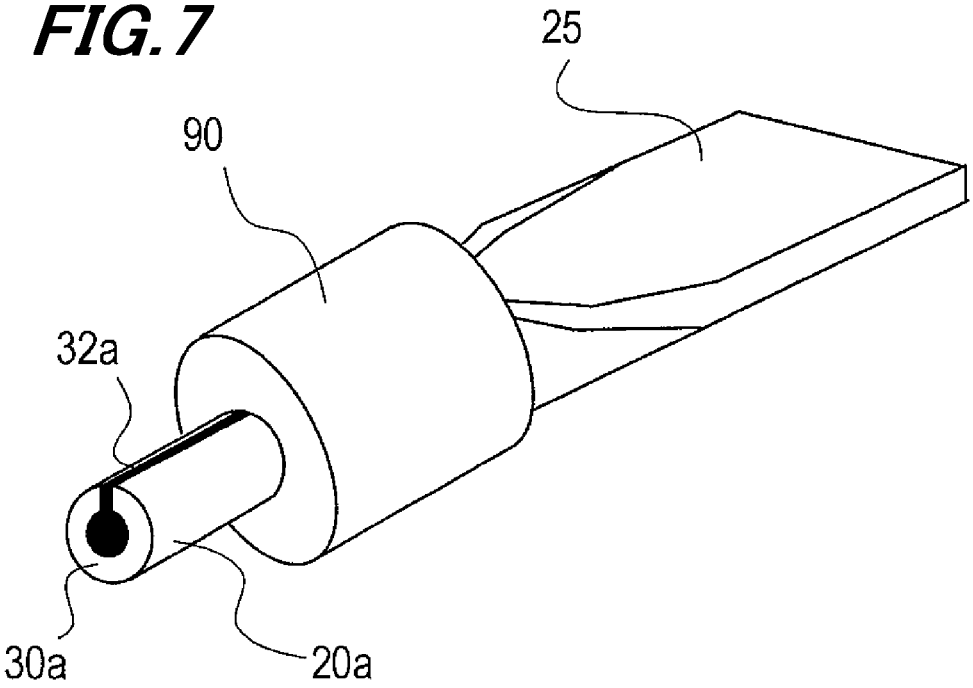
FIG. 7 is a diagram showing one example of a manufacturing method of a hollow single core wire according to the modified example of the exemplary embodiment.

FIG. 7 is a diagram showing one example of a manufacturing method of the hollow single core wire 20*a*. The hollow single core wire 20*a* is formed by drawing an elongated plate shaped member 25 made of metal such as aluminum alloy or copper alloy by a die 90. When a terminal 60 is crimped to the single core electric wire 10*a* having the hollow single core wire 20*a* formed in such a way, the same operation and effects as those of the above-described embodiment are obtained.

The present application is based on Japanese patent application No. 2011-147057 filed on Jul. 1, 2011, and the contents of the patent application are hereby incorporated by reference.

INDUSTRIAL APPLICABILITY

The present invention is useful for providing a terminal crimping structure of a single core electric wire, capable of to providing a technique that suppresses the decrease of a contact pressure due to creep in a crimping part of a single core electric wire and a terminal.

REFERENCE SIGNS LIST

10, 10*a* single core electric wire
20, 20*a* hollow single core wire
25 plate shaped member
30 hollow part
30*a* hollow central part
32*a* hollow side surface part
40 electric wire coat
60 terminal
62 barrel part
64 connecting part
66 barrel end part
80 crimping part
90 die

The invention claimed is:

1. A terminal crimping structure of a single core electric wire, comprising a single core wire coated with an electric wire coat and a terminal fitting, wherein the single core wire has a hollow part formed therein along an extending direction, and the hollow part is collapsed in a crimping part in which the single core wire is exposed and the terminal fitting.

2. A single core electric wire, comprising a single core wire coated with an electric wire coat, wherein the single core wire includes a hollow part formed therein, and the hollow part is collapsed when a terminal fitting is crimped in a part in which the single core wire is exposed.

3. The single core electric wire according to claim 2, wherein the hollow part is formed along an extending direction of the single core wire.

* * * * *